US008758967B2

(12) United States Patent
Sasaki et al.

(10) Patent No.: US 8,758,967 B2
(45) Date of Patent: Jun. 24, 2014

(54) TRANSPARENT TONER AND TONER IMAGE USING THE SAME, ELECTROSTATIC LATENT IMAGE DEVELOPER, TONER CARTRIDGE, PROCESS CARTRIDGE, IMAGE FORMING APPARATUS, AND IMAGE FORMING METHOD

(75) Inventors: Koji Sasaki, Kanagawa (JP); Masanobu Ninomiya, Kanagawa (JP); Tetsuya Taguchi, Kanagawa (JP); Atsushi Sugawara, Kanagawa (JP); Yukiaki Nakamura, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 13/544,422

(22) Filed: Jul. 9, 2012

(65) Prior Publication Data

US 2013/0216793 A1 Aug. 22, 2013

(30) Foreign Application Priority Data

Feb. 21, 2012 (JP) ..... 2012-035318

(51) Int. Cl.
*G03G 9/08* (2006.01)

(52) U.S. Cl.
USPC ..... 430/108.6; 430/123.51; 399/252

(58) Field of Classification Search
USPC ..... 430/108.6, 123.51; 399/252
See application file for complete search history.

(56) References Cited

U.S. PATENT DOCUMENTS

| | | | | |
|---|---|---|---|---|
| 5,913,092 | A | 6/1999 | Bisaiji et al. | |
| 6,156,471 | A * | 12/2000 | Kobori et al. | 430/108.6 |

FOREIGN PATENT DOCUMENTS

| | | |
|---|---|---|
| JP | A-61-236558 | 10/1986 |
| JP | A-09-236982 | 9/1997 |
| JP | A-10-115948 | 5/1998 |
| JP | A-10-115949 | 5/1998 |
| JP | A-2001-265051 | 9/2001 |
| JP | A-2002-341587 | 11/2002 |
| JP | A-2006-337943 | 12/2006 |
| JP | A-2010-85681 | 4/2010 |

* cited by examiner

*Primary Examiner* — Mark A Chapman
(74) *Attorney, Agent, or Firm* — Oliff PLC

(57) ABSTRACT

A transparent toner for developing an electrostatic latent image includes toner particles containing a binder resin; and an external additive containing cerium oxide, in which a content of cerium in all toner particles is from 0.05% by weight to 0.20% by weight, the cerium oxide contains a praseodymium, and a content of praseodymium in all toner particles is from 0.001% by weight to 0.050% by weight.

19 Claims, 1 Drawing Sheet

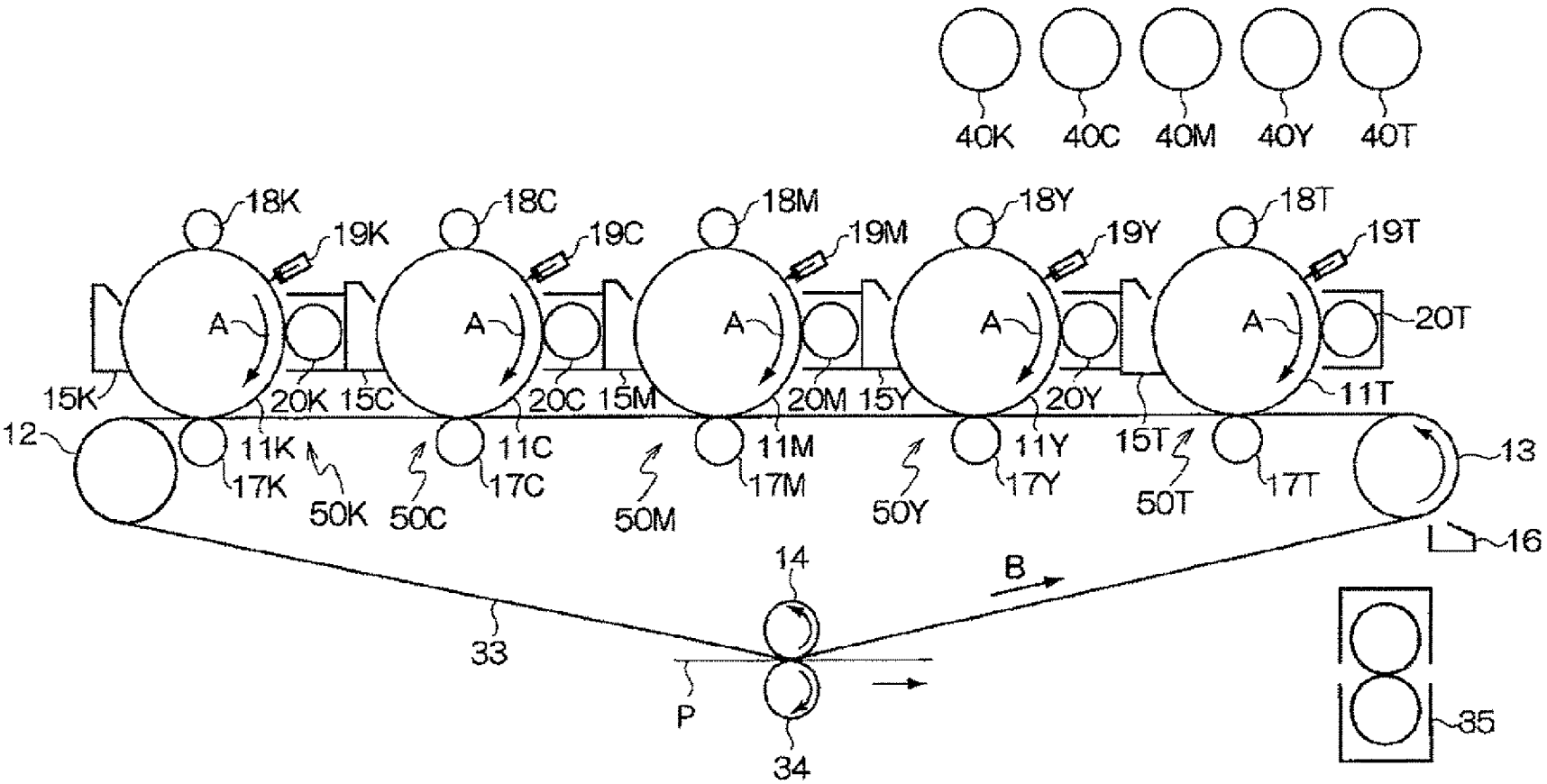
40T
40Y
40M
40C
40K
18T
19T
20T
11T
17T
15T
50T
18Y
19Y
20Y
11Y
17Y
15Y
50Y
18M
19M
20M
11M
17M
15M
50M
18C
19C
20C
11C
17C
15C
50C
18K
19K
20K
11K
17K
15K
50K
A
B
13
16
35
14
34
P
33
12

TRANSPARENT TONER AND TONER IMAGE USING THE SAME, ELECTROSTATIC LATENT IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-035318 filed Feb. 21, 2012.

BACKGROUND

1. Technical Field

The present invention relates to a transparent toner and a toner image using the same, an electrostatic latent image developer, a toner cartridge, a process cartridge, an image forming apparatus, and an image forming method.

2. Related Art

A method using electrophotography or the like in which image information is visualized through an electrostatic latent image, is currently being used in various fields. In electrophotography, image information is visualized as an image through the following processes: a charging and exposure (latent image forming) process in which an electrostatic latent image containing image information is formed on the surface of a latent image holding member (photoreceptor); a transfer process in which a toner image is developed on the surface of the photoreceptor by using a developer containing a toner and this toner image is transferred onto a recording medium (transfer medium) such as paper; and a fixing process in which the toner image is fixed onto the recording medium.

In color electrophotography which has been widely used in recent years, in order to form a color image, in general, colors are reproduced using four color toners including three color toners (yellow, magenta, and cyan which are three subtractive primary colors) and black toner.

In general color electrophotography, colors of a document image (image information) are separated into yellow, magenta, cyan, and black and an electrostatic latent image is formed on the surface of the photoreceptor for each color. At this time, the electrostatic latent image which is formed for each color toner is developed using a developer containing each color toner and thus a toner image is formed. Then, the toner image is transferred onto the recording medium through the transfer process. A set of processes from the electrostatic latent image forming process to the process of transferring the toner image onto the recording medium is performed sequentially for each color. The toner image of each color overlaps and is transferred onto the surface of the recording medium so as to match the image information. In the transfer process, the toner image is transferred onto the recording medium through an intermediate transfer member or is transferred directly onto the recording medium.

Accordingly, a color toner image, which is obtained by transferring the toner image of each color onto the recording medium, is fixed as a color image through the fixing process.

In the color image forming process, in addition to yellow (Y), magenta (M), cyan (C), and black (BK) toners which are used in the related art, there have been attempts to use a transparent toner for correcting a gloss difference in the surface of an image, controlling a gloss on the surface of a transfer paper, and correcting an image density and an amount of toner attached.

Furthermore, there have been attempts to use the transparent toner for giving a stereoscopic effect to an image.

SUMMARY

According to an aspect of the invention, there is provided a transparent toner for developing an electrostatic latent image including toner particles containing a binder resin and an external additive containing cerium oxide, in which a content of cerium in all toner particles is from 0.05% by weight to 0.20% by weight, the cerium oxide contains a praseodymium, and a content of praseodymium in all toner particles is from 0.001% by weight to 0.050% by weight.

BRIEF DESCRIPTION OF THE DRAWINGS

Exemplary embodiment of the present invention will be described in detail based on the following figures, wherein:

FIG. 1 is a schematic diagram illustrating a configuration example of an image forming apparatus according to an exemplary embodiment of the invention.

DETAILED DESCRIPTION

Hereinafter, exemplary embodiments of a transparent toner and a toner image using the same, an electrostatic latent image developer, a toner cartridge, a process cartridge, an image forming apparatus, and an image forming method according to the invention will be described.

Transparent Toner

A transparent toner represents a toner which does not contain pigment or contains 100 ppm or less of a pigment. A transparent toner according to an exemplary embodiment of the invention (hereinafter, referred to as the toner according to the exemplary embodiment) includes toner particles containing a binder resin and an external additive containing cerium oxide. In this toner, the content of cerium in all toner particles is from 0.05% by weight to 0.20% by weight and the content of praseodymium in all toner particles is from 0.001% by weight to 0.05% by weight.

When an image is formed using electrophotography, transfer residual toner, fog toner, or foreign substances such as discharge products or paper powder are attached to a photoreceptor and an intermediate transfer member of an image forming apparatus. Therefore, these contaminants are removed by, for example, a cleaning blade or cleaning brush. In order to promote the removal of these contaminants, an abrasive (cleaning aid) may be added to a toner as an external additive. As the abrasive, cerium oxide is preferable from the viewpoints of cost and abradability for the surface of a photoreceptor.

Cerium is a rare-earth element. The rare-earth elements are metal elements which belong to the fourth to sixth periods of group three in the periodic table, which have similar chemical properties. Furthermore, since the rare-earth elements are produced together mines, they are difficult to separate from each other. Therefore, when low-purity cerium oxide is used as the external additive of the transparent toner, a fixed image has a tendency to become haze due to foreign substances included in the cerium oxide external additive. In addition, when high-purity cerium oxide is used, the haze of a fixed image is removed. However, crystal defects of cerium are reduced and the electric resistance is increased. Cerium oxide has a tendency to be transferred from a photoreceptor to a transfer belt or the surface of paper and thus it is difficult for it to remain in the photoreceptor. As a result, the abrasive effect on the surface of the photoreceptor which is caused by cerium oxide has a tendency to deteriorate.

Color temperature represents quantitative values indicating the hue of light. The color temperature of a light source is the absolute temperature of a black body that radiates light of comparable hue to that of the light source. For example, the color temperature of a candle light is approximately 1800K, the color temperature of a halogen lamp is approximately 3000K, the color temperature of a fluorescent lamp is approximately 5200K, the color temperature of sunlight is approximately 5500K, and the color temperature of a blue sky is approximately 12000K. In this way, the color temperature of red light is low, and when the color temperature of red light becomes greater, the light is changed to orange, yellow, white, and blue. When the color temperature of light is equal to or less than 5000K, the value is slightly less than the 5200K of the fluorescent lamp. Therefore, it can be said that the light is approximately white. When the color temperature of light becomes less than 5000K, the light contains more yellow light components, but the light can be recognized as approximately white until 4000K.

Praseodymium oxide, which is one of the impurities included in cerium oxide, is a slightly yellow color. When cerium oxide is used as the abrasive of the transparent toner, praseodymium oxide, which has similar chemical properties to cerium oxide, may be mixed into cerium oxide. In this case, due to the transparent toner affected by praseodymium oxide, a fixed image has a tendency to be yellowish. However, with regard to specific light (having a color temperature of 5000K or less), gray components which are derived from impurities included in cerium other than praseodymium are balanced out by the color of praseodymium oxide. As a result, transparency is held. Therefore, while cerium oxide is used, the transparency of a toner image can be obtained. As described above, it is preferable that the color temperature is from 4000K to 5000K.

In the exemplary embodiment, the content of cerium in all toner particles is from 0.05% by weight to 0.20% by weight, preferably from 0.08% by weight to 0.18% by weight, and still more preferably 0.10% by weight to 0.18% by weight.

When the content of cerium in all toner particles is less than 0.05% by weight, the abrasive effect on the surface of a photoreceptor may be insufficient. On the other hand, when the content of cerium in all toner particles is greater than 0.20% by weight, the abrasive effect is excessive. As a result, members may be damaged.

In the exemplary embodiment, when the content of cerium in all toner particles is from 0.05% by weight to 0.20% by weight, the content of praseodymium in all toner particles is from 0.001% by weight to 0.05% by weight, preferably from 0.001% by weight to 0.01% by weight, and more preferably from 0.001% by weight to 0.005% by weight.

When the content of praseodymium in all toner particles is less than 0.001% by weight, an effect of balancing out gray components derived from impurities, which are included in cerium oxide as the external additive other than praseodymium, may be insufficient. As a result, a fixed image may be turbid. On the other hand, when the content of praseodymium in all toner particles is greater than 0.05% by weight, the transparency of a fixed image may deteriorate due to a yellow component derived from praseodymium.

In a case where the content of cerium in all toner particles is from 0.05% by weight to 0.20% by weight and the content of praseodymium in all toner particles is from 0.001% by weight to 0.05% by weight, when the amount of toner particles deposited on a toner image is 3 g/m$^2$, the hue of the toner image is light. As a result, an image, which has excellent transparency under the environment of a color temperature of 5000K or less, is formed.

In a case where the content of cerium in all toner particles is from 0.05% by weight to 0.20% by weight and the content of praseodymium in all toner particles is from 0.001% by weight to 0.01% by weight, when the amount of toner particles deposited on a toner image is 20 g/m$^2$, the hue of the toner image is light. As a result, a transparent toner image, which has a thickness enabling a smooth texture, has excellent transparency under the environment of a color temperature of 5000K or less.

In the exemplary embodiment, it is preferable that cerium and praseodymium in all toner particles be derived from cerium oxide which is added as the external additive.

In the exemplary embodiment, the contents of cerium and praseodymium in all toner particles are measured by the following method.

As the pretreatment of a test sample, 6 g of toner is compressed by a compression molding machine under a pressure of 20 tons for 30 seconds to prepare a compressed molding having a diameter of 50 mm. The prepared compressed molding is measured using an X-ray fluorescence spectrometer (ZSX Primus II, manufactured by Rigaku Corporation).

Hereinafter, the respective components included in the toner according to the exemplary embodiment will be described.

The toner according to the exemplary embodiment includes the toner particles containing a binder resin and the external additive containing cerium oxide.

Binder Resin

The toner particles according to the exemplary embodiment contain the binder resin.

As the binder resin, for example, thermoplastic binder resins which are well-known in the related art are used, and specific examples thereof include polyester resin; a homopolymer or copolymer of styrenes (styrene resin) such as styrene, para-chlorostyrene, or α-methylstyrene; a homopolymer or copolymer of esters having a vinyl group (vinyl resin) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; a homopolymer or copolymer of vinyl nitriles (vinyl resin) such as acrylonitrile or methacrylonitrile; a homopolymer or copolymer of vinyl ethers (vinyl resin) such as vinylmethylether or vinyl isobutyl ether; a homopolymer or copolymer of vinyl ketones (vinyl resin) such as methyl vinyl ketone, ethyl vinyl ketone, or vinylisopropenyl ketone; a homopolymer or copolymer of olefins (olefin resin) such as ethylene, propylene, butadiene, or isoprene; non-vinyl condensed resin such as epoxy resin, polyurethane resin, polyamide resin, cellulose resin, or polyether resin; and graft polymer of non-vinyl condensed resin and vinyl monomer.

Among these, polyester resin is preferable as the binder resin from the viewpoints of fixability and an effect that the light yellow of a resin easily promotes the effect of praseodymium.

The kind of polyester resin is not particularly limited and a well-known polyester resin may be used.

Polyester Resin

In the exemplary embodiment, polyester resin is used because polyester resin is advantageous when fixing is performed at a low temperature due to the rapid response to heat of the intermolecular forces of polyester resin.

For these reasons, polyester resin is preferable from the viewpoints of improving toner intensity and the fix level of a fixed image.

Polyester resin which is preferably used in the exemplary embodiment is obtained by polycondensation of polyvalent carboxylic acids and polyols.

Examples of polyvalent carboxylic acids include aromatic carboxylic acids such as terephtalic acid, isophthalic acid, phthalic anhydride, trimellitic anhydride, pyromellitic acid, or naphthalenedicarboxylic acid; aliphatic carboxylic acids such as maleic anhydride, fumaric acid, succinic acid, alkenyl succinic anhydride, or adipic acid; and alicyclic carboxylic acids such as cyclohexanedicarboxylic acid. Polyvalent carboxylic acids may be used alone or in combination with two or more kinds. Among polyvalent carboxylic acids, aromatic carboxylic acids are preferably used. In order to provide a cross-linked structure or branched structure for securing excellent fixability, it is preferable that a dicarboxylic acid and a trivalent or more carboxylic acid (such as trimellitic acid or an anhydride thereof) be used in combination.

Examples of polyols in polyester resin include aliphatic diols such as ethylene glycol, diethylene glycol, triethylene glycol, propylene glycol, butanediol, hexanediol, neopentylglycol, or glycerin; alicyclic diols such as cyclohexanediol, cyclohexanedimethanol, or hydrogenated bisphenol A; and aromatic diols such as ethylene oxide adducts of bisphenol A or propylene oxide adducts of bisphenol A. Polyols may be used alone or in combination with two or more kinds. Among polyols, aromatic diols and alicyclic diols are preferable, and aromatic dials are most preferable from the viewpoint that a resin is easily made light yellow. In addition, in order to provide a cross-linked structure or branched structure for obtaining further excellent fixability, a diol and a trivalent or more alcohol (glycerin, trimethylolpropane, or pentaerythritol) may be used in combination.

It is preferable that the glass transition temperature (Tg) of polyester resin be from 50° C. to 80° C. When Tg is lower than 50° C., a problem may occur with the preservability of the toner and a fixed image. In addition, when Tg is higher than 80° C., fixing may not be performed at a lower temperature than that of the related art.

It is more preferable that Tg of polyester resin be from 50° C. to 65° C.

In addition, the glass transition temperature of polyester resin is obtained as the peak temperature of an endothermic peak which is obtained using Differential Scanning calorimetry (DSC) described above.

In addition, it is preferable that the weight average molecular weight (Mw) of polyester resin be from 8000 to 30000, and it is more preferable that the weight average molecular weight (Mw) be from 8000 to 16000 from the viewpoints of low-temperature fixability and mechanical strength. In addition, a third component may be copolymerized from the viewpoints of low-temperature fixability and miscibility.

Polyester resin is synthesized from an acid component (dicarboxylic acid) and an alcohol component (diol). The preparation method of polyester resin is not limited to a preparation method which will be described below, and polyester resin can be prepared using a general polyester polymerization method.

The preparation method of polyester resin is not particularly limited. Polyester resin can be prepared using a general polyester polymerization method in which a carboxylic acid component and an alcohol component are caused to react with each other, for example, direct polycondensation or transesterification. The preparation method used depends on the kind of monomer. The molar ratio when the acid component and the alcohol component are caused to react with each other (acid component/alcohol component) is difficult to define because it changes according to reaction conditions and the like. However, generally, the molar ratio is approximately 1/1.

Polyester resin can be prepared at a polymerization temperature of from 180° C. to 230° C. Optionally, the pressure in a reaction system is reduced and the reaction is performed while removing water and alcohol generated during condensation. When a monomer is not dissolved or is insoluble at a reaction temperature, a solvent having a high boiling temperature may be added and dissolved as a solubilizer. A polycondensation reaction is performed while distilling the solubilizer. When there is a monomer having low solubility in the polycondensation reaction, first, the monomer having low solubility is condensed with a carboxylic acid component or an alcohol component, which will be polycondensated with the monomer, and is polycondensated with a main component.

Examples of a catalyst which can be used at the time of preparing polyester resin include an alkali metal compound such as sodium or lithium; an alkali earth metal compound such as magnesium or calcium; a metal compound such as zinc, manganese, antimony, titanium, tin, zirconium, or germanium; a phosphite compound; a phosphate compound; and an amine compound. Specific examples of the compounds are as follows.

Examples of the compounds include sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenylphosphonium bromide, triethylamine, and triphenylamine.

Release Agent

The toner particles according to the exemplary embodiment may contain a release agent. Examples of the release agent include paraffin wax such as low molecular weight polypropylene or low molecular weight polyethylene; silicone resin; rosins; rice wax; carnauba wax; ester wax; and montan wax. Among these, paraffin wax, ester wax and montan wax are preferable, and paraffin wax and ester wax are more preferable. The melting temperature of the release agent which is used in the exemplary embodiment is preferably from 60° C. to 130° C. and more preferably from 70° C. to 120° C. The content of the release agent in all toner particles is preferably from 0.5% by weight to 15% by weight and more preferably from 1.0% by weight to 12% by weight. When the content of the release agent is less than 0.5% by weight, separation failure may occur in the case of oil-less fixing. When the content of the release agent is greater than 15% by weight, the quality and reliability of a formed image may deteriorate due to a deterioration in the fluidity of toner or the like.

Other Additives

Optionally, various other components such as an internal additive, a charge-controlling agent, inorganic powder (inorganic particles), or organic particles may be added to the toner particles according to the exemplary embodiment, in addition to the above-described components.

An example of the internal additive includes a magnetic material, for example, metals such as ferrite, magnetite, reduced iron, cobalt, nickel, and manganese, an alloy thereof, or a compound including one of these metals.

Toner Properties

It is preferable that the volume average particle size of the toner particles according to the exemplary embodiment is from 4 μm to 9 μm, more preferably from 4.5 μm to 8.5 μm, and still more preferably from 5 μm to 8 μm. When the volume average particle size is smaller than 4 μm, toner fluidity deteriorates and the charging performance of each particle deteriorates easily. In addition, since the charge distribution is spread, background fog easily occurs or the toner easily spills from a developer unit. In addition, when the volume average particle size is smaller than 4 μm, the cleaning property deteriorates significantly. When the volume average particle size is larger than 9 μm, resolution deteriorates, sufficient quality is not obtained, and thus the high-quality demands of recent years may not be satisfied.

The volume average particle size is measured using a Coulter Multisizer II (manufactured by Beckman Coulter, Inc.) with an aperture diameter of 50 μm. At this time, toner is measured after being dispersed into an electrolyte aqueous solution (aqueous isotonic solution) using ultrasonic waves for 30 seconds or more.

Furthermore, in the toner according to the exemplary embodiment, it is preferable that the shape factor SF1 is in the range of 110 to 140. When the shape is spherical in the above-described range, transfer efficiency and image density are improved. As a result, a high-quality image is formed.

It is more preferable that the shape factor SF1 is in the range of 110 to 130.

The above-described shape factor SF1 is obtained by Expression (1) below.

$$SF1=(ML^2/A)\times(\pi/4)\times 100 \qquad \text{Expression (1)}$$

In Expression (1), ML represents the absolute maximum length of the toner and A represents the projection area of the toner.

Numerical values of SF1 are obtained by analyzing a microscopic image or a scanning electron microscopic (SEM) image using an image analyzer. For example, the values can be calculated as follows. That is, an optical microscopic image of particles which are dispersed on a glass slide is input to a Luzex image analyzer through a video camera, maximum lengths and projection areas of 100 particles are obtained and calculated using Expression (1) above, and the average values thereof are obtained. As a result, the numerical values of the SF1 are obtained.

The toner according to the exemplary embodiment may configure a toner set in combination with at least one kind of color toner selected from a group consisting of cyan toner, magenta toner, yellow toner, and black toner.

A colorant used for the color toner may be a dye or a pigment, but pigment is preferable from the viewpoints of light resistance and water resistance.

Preferable examples of the colorant include well-known pigments such as Carbon Black, Aniline Black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxide, Lamp Black, Rose Bengal, Quinacridone, Benzidine Yellow, C.I. PIGMENT RED 48:1, C.I. PIGMENT RED 57:1, C.I. PIGMENT RED 122, C.I. PIGMENT RED 185, C.I. PIGMENT RED 238, C.I. PIGMENT YELLOW 12, C.I. PIGMENT YELLOW 17, C.I. PIGMENT YELLOW 180, C.I. PIGMENT YELLOW 97, C.I. PIGMENT YELLOW 74, C.I. PIGMENT BLUE 15:1, and C.I. PIGMENT BLUE 15:3.

It is preferable that the content of the colorant in all toner particles of the color toner is from 1 part by weight to 30 parts by weight with respect to 100 parts by weight of the binder resin. In addition, optionally, a surface-treated colorant or a pigment dispersant may be used. By selecting the kind of the colorant, yellow toner, magenta toner, cyan toner, or black toner can be obtained.

The color toner according to the exemplary embodiment may contain the same components as those of the toner (transparent toner) according to the exemplary embodiment, in addition to the colorant. In addition, preferable ranges of the properties of the color toner such as particle size are the same as in the toner according to the exemplary embodiment.

Method of Preparing Toner

The method of preparing the toner according to the exemplary embodiment is not particularly limited, and dry methods such as a kneading and crushing method and wet methods such as an emulsion aggregation method or a suspension polymerization method which are well-known in the art are used. Among these methods, the emulsion aggregation method is preferable from the viewpoint that toner can be easily prepared while less toner surface is exposed to the release agent due to a core-shell structure thereof. Hereinafter, the method of preparing the toner according to the exemplary embodiment using the emulsion aggregation method will be described in detail.

It is preferable that the method of preparing the toner according to the exemplary embodiment include at least an aggregated particle forming process of mixing a polyester resin particle dispersion, in which polyester resin particles are dispersed, with a release agent particle dispersion, which is optionally used and in which release agent particles are dispersed, and forming aggregated particles which contain the polyester resin particles and the release agent particles; and a coalescing process of heating the aggregated particles to be coalesced.

In addition, as the polyester resin particles, crystalline polyester resin particles and amorphous polyester resin particles may be used in combination.

By dispersing the release agent, the release agent particle dispersion having release agent particles with a volume average particle size of 1 μm or smaller is obtained. It is more preferable that the volume average particle size of the release agent particles is from 100 nm to 500 nm.

When the volume average particle size is smaller than 100 nm, in general, it is difficult to mix a release agent component into toner although also affected by properties of a polyester resin to be used. In addition, when the volume average particle size is larger than 500 nm, the dispersal state of the release agent in the toner may be insufficient.

The polyester resin particle dispersion may be prepared by a disperser applying a shearing force to a solution in which an aqueous medium and a polyester resin are mixed. At this time, particles may be formed by heating a resin component to lower the viscosity thereof. In addition, in order to stabilize the dispersed resin particles, a dispersant may be used. Furthermore, when polyester resin is dissolved in an oil-based solvent having relatively low solubility in water, the resin is dissolved in the solvent and particles thereof are dispersed in water with a dispersant and a polymer electrolyte, followed by heating and reduction in pressure to evaporate the solvent. As a result, the polyester resin particle dispersion is prepared.

Examples of the aqueous medium include water such as distilled water or ion exchange water; and alcohols, and water only is preferable.

In addition, examples of the dispersant which is used in an emulsification process include a water-soluble polymer such as polyvinyl alcohol, methyl cellulose, ethyl cellulose, hydroxyethyl cellulose, carboxymethyl cellulose, sodium polyacrylate, or poly(sodium methacrylate); a surfactant such as an anionic surfactant (for example, sodium dodecylbenzenesulfonate, sodium octadecyl sulfate, sodium oleate, sodium laurate, or potassium stearate), cationic surfactant (for example, laurylamine acetate, stearylamine acetate, or lauryl trimethylammonium chloride), zwitterionic surfactant (for example, lauryl dimethylamine oxide), or nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for preparing an emulsion include a homogenizer, a homomixer, a pressure kneader, an extruder, and a media disperser. With regard to the size of the resin particles, the average particle size (volume average particle size) thereof is preferably lower than or equal to 1.0 μm, more preferably from 60 nm to 300 nm, and still more preferably from 150 nm to 250 nm. When the volume average particle size is lower than 60 nm, the resin particles are stabilized in the dispersion and thus the aggregation of the resin particles may be difficult. In addition, when the volume average particle size is larger than 1.0 μm, the aggregability of the resin particles is improved and the toner particles are easily prepared. However, the distribution of toner particle sizes may be spread out.

Aggregated Particle Forming Process

In the aggregated particle forming process, the polyester resin particle dispersion is mixed with the release agent particle dispersion, which is optionally used, to obtain a mixture and the mixture is heated at the glass transition temperature of the polyester resin particles or at a melting temperature thereof or lower and aggregated to form aggregated particles. The aggregated particles are formed by adjusting the pH value of the mixture to be acidic while stirring the mixture. The pH value is preferably from 2 to 7, more preferably 2.2 to 6, and still more preferably 2.4 to 5. At this time, use of a coagulant is also effective.

In an aggregation process, the release agent particle dispersion may be added and mixed at once or across multiple times.

As the coagulant, a surfactant having a reverse polarity to that of a surfactant which is used as the dispersant; an inorganic metal salt; and a divalent or more metal complex may be preferably used. In particular, the metal complex is particularly preferable because the amount of the surfactant used can be reduced and a charge performance is improved.

Examples of the inorganic metal salt include a metal salt such as calcium chloride, calcium nitrate, barium chloride, magnesium chloride, zinc chloride, aluminum chloride, or aluminum sulfate; and an inorganic metal salt polymer such as polyaluminum chloride, polyaluminum hydroxide, or calcium polysulfide. Among these, an aluminum salt and a polymer thereof are preferable. In order to obtain a sharper particle size distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. In addition, when inorganic metal salts having the same valence are compared, a polymer type of inorganic metal salt polymer is more preferable.

In the exemplary embodiment, a tetravalent inorganic metal salt polymer containing aluminum is preferable because a sharp particle size distribution can be obtained.

In addition, after the aggregated particles have desired particle sizes, the polyester resin particles are added (coating process). As a result, a toner having a configuration in which the surfaces of core aggregated particles are coated with polyester resin, may be prepared. Accordingly, since less toner surface is exposed to the release agent, the ratio of a toner surface exposed to the release agent is lower than or equal to 10%. When the polyester resin particles are added, the coagulant may be added or the pH value may be adjusted before adding.

Coalescing Process

In the coalescing process, under stirring conditions based on the aggregation process, by increasing the pH value of a suspension of the aggregated particles to be in a range of 3 to 9, aggregation is stopped. Then, heating is performed at the glass transition temperature of the polyester resin particles or at the melting temperature or higher to coalesce the aggregated particles. In addition, when polyester resin is used for coating, polyester resin is also coalesced and coats the core aggregated particles. The heating time may be determined according to a coalescing degree and may be approximately from 0.5 hours to 10 hours.

After coalescing, cooling is performed to obtain coalesced particles. In addition, in a cooling process, a cooling rate may be reduced around the melting temperature of polyester resin (the range of the melting temperature ±10° C.), that is, so-called slow cooling may be performed to promote crystallization.

The coalesced particles which are obtained after coalescing may be subjected to a solid-liquid separation process such as filtration, and optionally to a cleaning process and a drying process to obtain toner particles.

External Additive and Internal Additive

Cerium oxide is added to the obtained toner particles as the external additive. The volume average particle size of cerium oxide is preferably in the range of 0.3 μm to 5 μm and more preferably in the range of 0.4 μm to 2.0 μm.

The ratio of cerium to praseodymium (Ce/Pr) in cerium oxide as the external additive is preferably from 20 to 150 and more preferably from 20 to 100 because the range of 20 to 100 is particularly effective for an image having large amounts of toner particles deposited.

The amount of cerium oxide added is preferably from 0.05 part by weight to 1.0 part by weight, more preferably from 0.08 part by weight to 0.80 part by weight, still more preferably from 0.10 part by weight to 0.80 part by weight, with respect to 100 parts by weight of toner particles.

Cerium oxide may be prepared using well-known preparation methods. For example, impurities are removed from bastnaesite concentrate as a base material to obtain a carbonate, followed by sintering, crushing, and classification. As a result, cerium oxide particles having desired particle sizes can be prepared. Then, a wet preparation method may be performed, in which a base such as ammonia water is added to an aqueous cerium oxide solution for neutralization and a precipitation is precipitated, followed by heating in a pressure resistant vessel and crystallization to obtain cerium oxide particles.

When a natural ore is used as a base material, the base material contains praseodymium in addition to cerium. In order to adjust the ratio of cerium and praseodymium, in the preparation method of cerium oxide, before sintering, cleaning may be performed using tributyl phosphate, concentrated nitric acid, and the like to remove praseodymium. More specifically, tributyl phosphate may remove impurities other than cerium and praseodymium more effectively, as compared to the case of cerium and praseodymium. Concentrated nitric acid is usually effective for removing praseodymium.

Cerium oxide may be added using, for example, a V-blender, Henschel mixer, or Loedige Mixer and bonded through plural steps.

In addition, in order to adjust charging and to impart fluidity and charge exchangeability, inorganic particles represented by silica, titania, or alundum may be added and bonded to the obtained toner particles.

Examples of the inorganic particles include silica, alumina, titanium oxide, zinc oxide, silica sand, clay, mica, wollastonite, diatomaceous earth, colcothar, magnesium oxide, zirconium oxide, silicon carbide, or silicon nitride. Among these, silica particles and/or titania particles are preferable, and in particular, hydrophobized silica particles are preferable.

As means for the hydrophobization, methods which are well-known in the art may be used. Specifically, coupling treatment with silane, titanate, or aluminate may be used. A coupling agent which is used for coupling treatment is not particularly limited and preferable examples thereof include a silane coupling agent such as methyltrimethoxysilane, phenyltrimethoxysilane, methylphenyldimethoxysilane, diphenyldimethoxysilane, vinyl trimethoxysilane, γ-aminopropylmethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilanes, or hexamethyldisilazane; a titanate coupling agent; and an aluminate coupling agent.

Furthermore, optionally, various additives may be added and examples of the additives include a plasticizer, a cleaning aid such as polystyrene particles, polymethyl methacrylate particles, or polyvinylidene fluoride particles, and a lubricant for removing substances attached to a photoreceptor, such as zinc stearyl amid or zinc stearate.

The added amount of the external additives other than cerium oxide is preferably from 0.1 part by weight to 5 parts by weight and more preferably from 0.3 part by weight to 2 parts by weight, with respect to 100 parts by weight of toner particles. When the amount is less than 0.1 part by weight, the fluidity of the toner may deteriorate and furthermore a charging performance and charge exchangeability may deteriorate, which is not preferable. On the other hand, When the amount is greater than 5 parts by weight, particles are coated excessively, inorganic oxide is transferred to a contact member excessively, which may lead to secondary damage.

Furthermore, optionally, coarse particles of toner may be removed using an ultrasonic screening machine, a vibration screening machine, or a wind screening machine after the external additives are added.

In addition, in addition to the above-described external additives, other components (particles) such as a charge-controlling agent or organic particles may be added.

The charge-controlling agent is not particularly limited, and a colorless or light-colored one may be preferably used. Examples thereof include a quaternary ammonium salt compound, a nigrosine compound, a complex such as aluminum, iron, or chrome, and triphenylmethane-based pigment.

As the organic particles, for example, particles of vinyl resin, polyester resin, silicone resin and the like which are normally used as an external additive for a toner surface, are used. The inorganic particles and the organic particles may be used as a fluidity aid, a cleaning aid, or the like.

Electrostatic Latent Image Developer

The electrostatic latent image developer according to the exemplary embodiment contains at least the toner according to the exemplary embodiment.

The toner according to the exemplary embodiment may be used as a single-component developer or a two-component developer. When used as a two-component developer, the toner according to the exemplary embodiment is mixed with a carrier.

The carrier which can be used for the two-component developer is not particularly limited, and a well-known carrier may be used. For example, a resin-coated carrier which has a resin coating layer on the surface of a core material formed of magnetic metal such as iron oxide, nickel, or cobalt and magnetic oxide such as ferrite or magnetite; and a magnetic powder-dispersed carrier may be used. In addition, a resin-dispersed carrier in which a conductive material and the like are dispersed in a matrix resin may be used.

Examples of the coating resin and the matrix resin which are used for the carrier include polyethylene, polypropylene, polystyrene, polyvinyl acetate, polyvinyl alcohol, polyvinyl butylal, polyvinyl chloride, polyvinyl ether, polyvinylketone, vinyl chloride-vinyl acetate copolymer, styrene-acrylic acid copolymer, linear silicone resin having an organosiloxane bond or a modified product thereof, fluororesin, polyester, polycarbonate, phenol resin, and epoxy resin. However, the coating resin and the matrix resin are not limited to these examples.

Examples of the conductive material include metals such as gold, silver, and copper and carbon black and furthermore titanium oxide, zinc oxide, barium sulfate, aluminum borate, potassium titanate, tin oxide, and carbon black. However, the conductive material is not limited to these examples. It is preferable that the conductive material be a white conductive material such as zinc oxide or titanium oxide. When carrier particles are transferred to a transfer medium through the white conductive material, it is difficult to visually recognize the carrier particles in a toner image.

In addition, examples of the core material of the carrier include a magnetic metal such as iron, nickel or cobalt, magnetic oxide such as ferrite or magnetite, and glass beads. In order to apply a magnetic brush method to the carrier, magnetic material is preferable. In general, the volume average particle size of the core material of the carrier is from 10 μm to 500 μm and preferably from 30 μm to 100 μm.

In order to coat the surface of the core material of the carrier with resin, there may be used, for example, a coating method using a coating layer-forming solution which is obtained by dissolving the coating resin and optionally various additives in an appropriate solvent. The solvent is not particularly limited and may be selected according to coating resin to be used, coating aptitude, and the like.

Specific examples of the resin coating method include a dipping method in which the core material of the carrier is dipped in the coating layer-forming solution, a spray method in which the coating layer-forming solution is sprayed on the surface of the core material of the carrier, a fluid bed method in which the coating layer-forming solution is sprayed on the core material of the carrier in a state of floating through flowing air, and a kneader coater method in which the core material of the carrier and the coating layer-forming solution are mixed in a kneader coater and the solvent is removed.

In the two-component developer, the mixing ratio (weight ratio) of the toner and the carrier according to the exemplary embodiment is preferably from 1:100 to 30:100 (toner:carrier) and more preferably 3:100 to 20:100.

Toner Cartridge, Process Cartridge, Image Forming Apparatus, and Image Forming Method The image forming apparatus according to the exemplary embodiment includes a latent image holding member; a charging unit that charges a surface of the latent image holding member with electricity; a latent image forming unit that forms an electrostatic latent image on the charged surface of the latent image holding member; a developing unit that forms a toner image by developing the electrostatic latent image, which is formed on the surface of the latent image holding member, using the electrostatic latent image developer according to the exemplary embodiment; and a transfer unit that transfers the toner image, which is formed on the surface of the latent image holding unit, onto a transfer medium. Optionally, the image forming apparatus may further include other units such as a fixing unit that fixes the toner image transferred onto the transfer medium and a cleaning unit that cleans a non-transferred residual component of the latent image holding member.

The image forming method according to the exemplary embodiment is performed by the image forming apparatus according to the exemplary embodiment, and includes a charging process of charging a surface of the latent image holding member with electricity; a latent image forming process of forming an electrostatic latent image on the charged surface of the latent image holding member; a developing process of developing the electrostatic latent image, which is formed on the surface of the latent image holding member, to form a toner image by using the electrostatic latent image developer according to the exemplary embodiment; and a transfer process of transferring the toner image, which is formed on the surface of the latent image holding member, onto a transfer medium; and optionally a fixing process of fixing the toner image transferred onto the transfer medium.

In addition, in the image forming apparatus, for example, a portion including the developing unit may have a cartridge structure (process cartridge) which is detachable from the image forming apparatus main body. The process cartridge includes at least a developer holding member. Preferably, the process cartridge according to the exemplary embodiment which accommodates the electrostatic latent image developer according to the exemplary embodiment, is used.

Hereinafter, the image forming apparatus according to the exemplary embodiment will be described with reference to the drawings.

FIG. 1 is a schematic diagram illustrating a configuration example of the image forming apparatus according to the exemplary embodiment. The image forming apparatus according to the exemplary embodiment adopts a tandem-type intermediate transfer method in which primary transfer is performed by sequentially overlapping toner images of the respective colors on an intermediate transfer member and secondary transfer is performed by collectively transferring the primary-transferred images on the intermediate transfer member onto a transfer medium.

As shown in FIG. 1, in the image forming apparatus according to the exemplary embodiment, four image forming units 50Y, 50M, 50C, and 50K that form images of the respective colors including yellow, magenta, cyan, and black and an image forming unit 50T that forms a transparent image are arranged in parallel (in tandem) at intervals.

In this exemplary embodiment, the respective image forming units 50Y, 50M, 50C, 50K, and 50T have the same configuration except for the color of toner in the developer included therein. Therefore, the image forming unit 50Y that forms a yellow image will be described as a representative example. In addition, the same components as those of the image forming unit 50Y are represented by reference numerals to which the symbols M (magenta), C (cyan), K (black), and T (transparent) are attached instead of the symbol Y (yellow), and the descriptions of the respective image forming units 50M, 50C, 50K, and 50T will not be repeated. In the exemplary embodiment, the toner according to the exemplary embodiment is used as the toner (transparent toner) in the developer which is included in the image forming unit 50T.

The yellow image forming unit 50Y includes a photoreceptor 11Y as the latent image holding member. This photoreceptor 11Y is rotated by a drive unit (not shown) at a predetermined process speed in a direction indicated by arrow A in the drawing. As the photoreceptor 11Y, for example, an organic photoreceptor having sensitivity to the infrared region is used.

A charging roller (charging unit) 18Y is provided above the photoreceptor 11Y. A predetermined voltage is applied to this charging roller 18Y by a power supply (not shown) and the surface of the photoreceptor 11Y is charged to a predetermined potential.

In the vicinity of the photoreceptor 11Y, an exposure device (latent image forming unit) 19Y that exposes the surface of the photoreceptor 11Y to light and forms an electrostatic latent image is arranged downstream from the charging roller 18Y in the rotation direction of the photoreceptor 11Y. In the exemplary embodiment, in consideration of space, as the exposure device 19Y, an LED array which may be reduced in size is used. However, the exposure device is not limited thereto and other latent image forming units which use laser beams and the like may be used.

In addition, in the vicinity of the photoreceptor 11Y, a developing device (developing unit) 20Y that includes a developer holding member holding a yellow developer is arranged downstream from the exposure device 19Y in the rotation direction of the photoreceptor 11Y. The developing device 20Y visualizes the electrostatic latent image, which is formed on the surface of the photoreceptor 11Y, using the yellow toner and forms a toner image on the surface of the photoreceptor 11Y.

Below the photoreceptor 11Y, an intermediate transfer belt (intermediate transfer member) 33 that primarily transfers the toner image formed on the surface of the photoreceptor 11Y is arranged across the lower areas of five photoreceptors 11T, 11Y, 11M, 11C, and 11K. This intermediate transfer belt 33 is urged against the surface of the photoreceptor 11Y by a primary transfer roller 17Y. In addition, the intermediate transfer belt 33 is suspended by three rollers including a drive roller 12, a support roller 13, and a bias roller 14, and is revolved in a direction indicated by arrow B at the same movement speed as the process speed of the photoreceptor 11Y. On the surface of the intermediate transfer belt 33, prior to the yellow toner image which is primarily transferred as described above, a transparent toner image is primarily transferred and the yellow toner image is primarily transferred. Then, the toner images of the respective colors including magenta, cyan, and black are primarily transferred and layered in series.

In addition, in the vicinity of the photoreceptor 11Y, a cleaning device 15Y for cleaning toner remaining on the surface of the photoreceptor 11Y and retransferred toner is arranged downstream from the primary transfer roller 17Y in the rotation direction (direction indicated by arrow A) of the photoreceptor 11Y. A cleaning blade of the cleaning device 15Y is attached on the surface of the photoreceptor 11Y so as to be urged in a counter-rotation direction.

A secondary transfer roller (secondary transfer unit) 34 is urged against the bias roller 14, which suspends the intermediate transfer belt 33, through the intermediate transfer belt 33. The toner image, which is primarily transferred and layered on the surface of the intermediate transfer belt 33, is electrostatically transferred onto the surface of a recording paper (transfer medium) P supplied from a paper cassette (not shown) in a portion where the bias roller 14 and the secondary transfer roller 34 are urged against each other. At this time, among the toner images which are transferred and layered on the intermediate transfer belt 33, the transparent toner image is positioned on the lowest layer (position in contact with the intermediate transfer belt 33). Therefore, among the toner images which are transferred onto the surface of the recording paper p, the transparent toner image is positioned on the highest layer.

As the transfer medium onto which the toner images are transferred, for example, plain paper or OHP sheet which is used for an electrophotographic copying machine or printer are used.

The amount of toner particles deposited on the toner image, which is formed using the toner according to the exemplary embodiment and transferred onto the transfer medium, may be from 3.0 g/m$^2$ to 20.0 g/m$^2$. Even if the amount of toner particles deposited on the toner image is 3.0 g/m$^2$ to 20.0 g/m$^2$, the toner image (transparent toner image) which is formed using the toner according to the exemplary embodiment has excellent transparency under an environment in which the color temperature is less than or equal to 5000K.

A fixing unit 35 that fixes the multilayer toner images, which are transferred onto the recording paper P, through heat and pressure to the surface of the recording paper P to obtain a permanent image, is arranged downstream from the secondary transfer roller 34.

As the fixing unit used in the exemplary embodiment, for example, there may be used a fixing belt of which the surface is formed of low surface energy material represented by a fluororesin component and silicone resin in a belt shape and a fixing roller of which the surface is formed of low surface energy material represented by a fluororesin component and silicone resin in a cylindrical shape.

Next, the operations of the respective image forming units 50T, 50Y, 50M, 50C, and 50K that form the images of colors including transparent, yellow, magenta, cyan, and black will be described. Since the operations of the respective image forming units 50T, 50Y, 50M, 50C, and 50K are the same, the operation of the yellow image forming unit 50Y will be described as a representative example.

In a yellow developer unit 50Y, the photoreceptor 11Y is rotated in the direction indicated by arrow A at the predetermined process speed. The charging roller 18Y charges the surface of the photoreceptor 11Y to a predetermined negative potential. Then, the surface of the photoreceptor 11Y is exposed to light by the exposure device 19Y and an electrostatic latent image corresponding to image information is formed thereon. Next, the developing device 20 Y reversely develops the toner which is charged to the negative potential, the electrostatic latent image which has been formed on the surface of the photoreceptor 11Y is visualized on the surface of the photoreceptor 11Y, and a toner image is formed. Then, the toner image on the surface of the photoreceptor 11Y is primarily transferred onto the surface of the intermediate transfer belt 33 by the primary transfer roller 17Y. After the primary transfer, non-transferred components such as toner remaining on the surface of the photoreceptor 11Y, are wiped off and cleaned by the cleaning blade of the cleaning device 15Y for the subsequent image forming process.

The above-described operations are performed in the respective image forming units 50T, 50Y, 50M, 50C, and 50K. Multilayer toner images which are visualized on the surfaces of the respective photoreceptors 11T, 11Y, 11M, 11C, and 11K are transferred onto the surface of the intermediate transfer belt 33 in series. In a color mode, multilayer toner images are transferred in order of transparent, yellow, magenta, cyan, and black. Likewise, in a two-color mode or three-color mode, single-layer or multilayer toner images of necessary color are transferred in the above-described order. Next, the single-layer or multilayer toner images, which have been transferred onto the surface of the intermediate transfer belt 33, are secondarily transferred onto the surface of the recording paper P supplied from the paper cassette (not shown) by the secondary transfer roller 34. Then, the toner images are heated and pressurized by the fixing unit 35 to be fixed. After the secondary transfer, toner remaining on the surface of the intermediate transfer belt 33 is cleaned by a belt cleaner 16 which is configured by a cleaning blade for the intermediate transfer belt 33.

In FIG. 1, the yellow image forming unit 50Y is configured as the process cartridge which is detachable from the image forming apparatus main body and in which the developing device 20Y that includes the developer holding member holding a yellow electrostatic latent image developer, the photoreceptor 11Y, the charging roller 18Y, and the cleaning device 15Y are integrated. In addition, similar to the image forming unit 50Y, the image forming units 50T, 50K, 50C, and 50M are also configured as the process cartridge.

Next, the toner cartridge according to the exemplary embodiment will be described. The toner cartridge according to the exemplary embodiment is detachably mounted on the image forming apparatus and accommodates toner which is supplied to the developing unit provided inside the image forming apparatus. The toner cartridge according to the exemplary embodiment accommodates at least toner and may further accommodate, for example, a developer according to the mechanism of the image forming apparatus.

Therefore, in the image forming apparatus from which the toner cartridge is detachable, by using the toner cartridge accommodating the toner according to the exemplary embodiment, the toner according to the exemplary embodiment may be easily supplied to the developing apparatus.

In the image forming apparatus shown in FIG. 1, toner cartridges 40Y, 40M, 40C, 40K, and 40T are detachable. The developing devices 20Y, 20M, 20C, 20K, and 20T are connected to the toner cartridges corresponding to the respective developing devices (colors) through toner supply tubes (not shown). In addition, when the amount of toner accommodated in a toner cartridge is small, this toner cartridge can be replaced with another one.

Toner Image

The toner image according to the exemplary embodiment is formed on a transfer medium using the toner according to the exemplary embodiment and the thickness thereof is from 6 μm to 40 μm.

The toner image (transparent toner image), which is formed using the toner according to the exemplary embodiment with a thickness of 6 μm to 40 μm, has excellent transparency under the environment of a color temperature of 5000K or less.

The toner image according to the exemplary embodiment may be formed directly on the surface of the transfer medium. Alternatively, a toner image, which is formed using color toner, may be interposed between the transfer medium and the toner image (transparent toner image) according to the exemplary embodiment. By forming the toner image (transparent toner image) according to the exemplary embodiment on the color toner image, the toner image, which is formed using color toner, may be interposed between the transfer medium and the toner image (transparent toner image) according to the exemplary embodiment. By adopting such a configuration, a stereoscopic effect is given to the color toner image by the transparent toner image.

EXAMPLES

Hereinafter, the exemplary embodiment will be described more specifically using Examples and Comparative Examples, but the exemplary embodiment is not limited to Examples below. In addition, unless specified otherwise, "part" and "%" represent "part by weight" and "% by weight".

Method of Measuring Toner Particle Size and Particle Size Distribution

In a method of measuring toner particle sizes and particle size distribution according to the exemplary embodiment, Coulter Multisizer II (manufactured by Beckman Coulter, Inc.) is used as the measurement device and ISOTON-II (manufactured by Beckman Coulter, Inc.) is used as an electrolytic solution.

As the measurement method, a surfactant is used as a dispersant, and preferably, 0.5 mg to 50 mg of measurement sample is added to 2 ml of 5% aqueous sodium alkylbenzene sulfonate solution. This solution is added to 100 ml to 150 ml of the electrolytic solution. The electrolytic solution in which the sample is suspended is dispersed using an ultrasonic disperser for approximately 1 minute, the particle size distribution of 2 μm to 60 μm particles is measured using the Multisizer II with an aperture having an aperture size of 100 μm, and the volume average particle size, GSDv, and GSDp is measured. The number of particles measured is 50000.

Method of Measuring Glass Transition Temperatures of Resin and Toner and Melting Temperature of Release Agent Glass transition temperatures (Tg) of a resin and a toner and a melting temperature of a release agent are obtained by a subjective maximum endothermic peak which is measured using a differential scanning calorimeter (DSC-7, manufactured by PerkinElmer Inc.) in accordance with ASTM D3418-8. The temperature correction of a detection portion in this device (DSC-7) is performed using the melting temperatures of indium and zinc and the quantity of heat is corrected using the heat of fusion of indium. The samples are put in an aluminum pan and an empty pan for comparison, heated at a temperature rise rate of 10° C./min, held for 5 minutes at 150° C., cooled using liquid nitrogen from 150° C. to 0° C. at −10° C./min, held for 5 minutes at 0° C., and heated again from 0° C. to 150° C. at 10° C./min. An onset temperature, which is obtained by analyzing an endothermic curve at the time of the second heating, is set to Tg. The melting temperature of the release agent is a peak temperature obtained by analyzing the endothermic curve.

Method of Measuring Weight Average Molecular Weight and Molecular Weight Distribution of Resin In the exemplary embodiment, the molecular weight and the molecular weight distribution of the binder resin are measured under the following conditions. As a gel permeation chromatography (GPC) device, "HLC-8120 GPC, SC-8020" (manufactured by Tosoh Corporation) is used. As a column, two of "TSK gel, Super HM-H" (manufactured by Tosoh Corporation, 6.0 mm ID×15 cm) are used. As an eluent, tetrahydrofuran (THF) is used. The test is conducted using a RI detector under the following conditions: a sample concentration of 0.5%; a flow rate of 0.6 ml/min; a sample injection amount of 10 μl; and a measurement temperature of 40° C. In addition, a calibration curve is prepared from ten of "polystyrene standard samples, TSK standard": "A-500", "F-1", "F-10", "F-80", "F-380", "A-2500", "F-4", "F-40", "F-128", and F-700" (manufactured by Tosoh Corporation).

Preparation of Cerium Oxide (1)

350 parts of concentrated nitric acid is added to 50 parts of coarse cerium hydroxide in which the content of cerium is 73.2% ($CeO_2$/TREO (Total Rare Earth Oxide)), heated to be dissolved, and diluted with water to obtain 500 parts of nitric acid solution. This nitric acid solution is extracted for 3 minutes using 1000 parts of kerosene solution containing 9.5% tributyl phosphate (TBP). After the extraction, the organic phase and the water phase are separated. 504 parts of 8.5 N aqueous nitric acid solution is added to the organic phase and washed, followed by organic phase separation and back-extraction with 100000 parts of aqueous solution containing 3000 parts of 35% hydrogen peroxide solution. Then, the water phase is separated and diluted ammonia water is added thereto. The obtained solution is recovered as cerium hydroxide and fired at 700° C. to obtain Cerium oxide (1). The results thereof are shown in Table 1.

Preparation of Cerium Oxide (2)

Cerium oxide (2) is prepared in the same preparation method of Cerium oxide (1), except that the content of tributyl phosphate (TBP) is changed from 9.5% to 7.5% and the amount of aqueous nitric acid solution is changed from 504 parts to 502 parts. The results thereof are shown in Table 1.

Preparation of Cerium Oxide (3)

Cerium oxide (3) is prepared in the same preparation method of Cerium oxide (1), except that the content of tributyl phosphate (TBP) is changed from 9.5% to 11% and the amount of aqueous nitric acid solution is changed from 504 parts to 475 parts. The results thereof are shown in Table 1.

Preparation of Cerium Oxide (4)

Cerium oxide (4) is prepared in the same preparation method of Cerium oxide (1), except that the content of tributyl phosphate (TBP) is changed from 9.5% to 7.5% and the amount of aqueous nitric acid solution is changed from 504 parts to 534 parts. The results thereof are shown in Table 1.

Preparation of Cerium Oxide (5)

Cerium oxide (5) is prepared in the same preparation method of Cerium oxide (1), except that the content of tributyl phosphate (TBP) is changed from 9.5% to 11% and the amount of aqueous nitric acid solution is changed from 504 parts to 507 parts. The results thereof are shown in Table 1.

Preparation of Cerium Oxide (6)

Cerium oxide (6) is prepared in the same preparation method of Cerium oxide (1), except that the content of tributyl phosphate (TBP) is changed from 9.5% to 7.5% and the amount of aqueous nitric acid solution is changed from 504 parts to 537 parts. The results thereof are shown in Table 1.

Preparation of Cerium Oxide (7)

Cerium oxide (7) is prepared in the same preparation method of Cerium oxide (1), except that the content of tributyl phosphate (TBP) is changed from 9.5% to 11% and the amount of aqueous nitric acid solution is changed from 504 parts to 510 parts. The results thereof are shown in Table 1.

Preparation of Cerium Oxide (8)

Cerium oxide (8) is prepared in the same preparation method of Cerium oxide (1), except that the content of tributyl phosphate (TBP) is changed from 9.5% to 7.5% and the amount of aqueous nitric acid solution is changed from 504 parts to 575 parts. The results thereof are shown in Table 1.

Preparation of Cerium Oxide (9)

Cerium oxide (9) is prepared in the same preparation method of Cerium oxide (1), except that the content of tributyl phosphate (TBP) is changed from 9.5% to 11% and the amount of aqueous nitric acid solution is changed from 504 parts to 548 parts. The results thereof are shown in Table 1.

Preparation of Cerium Oxide (10)

Cerium oxide (10) is prepared in the same preparation method of Cerium oxide (1), except that the content of tributyl phosphate (TBP) is changed from 9.5% to 5.8% and the amount of aqueous nitric acid solution is changed from 504 parts to 512 parts. The results thereof are shown in Table 1.

Preparation of Cerium Oxide (11)

Cerium oxide (11) is prepared in the same preparation method of Cerium oxide (1), except that the content of tributyl phosphate (TBP) is changed from 9.5% to 6.8% and the amount of aqueous nitric acid solution is changed from 504 parts to 506 parts. The results thereof are shown in Table 1.

Preparation of Cerium Oxide (12)

Cerium oxide (12) is prepared in the same preparation method of Cerium oxide (1), except that the content of tributyl phosphate (TBP) is changed from 9.5% to 5.8% and the amount of aqueous nitric acid solution is changed from 504 parts to 543 parts. The results thereof are shown in Table 1.

Preparation of Cerium Oxide (13)

Cerium oxide (13) is prepared in the same preparation method of Cerium oxide (1), except that the content of tributyl phosphate (TBP) is changed from 9.5% to 6.8% and the amount of aqueous nitric acid solution is changed from 504 parts to 538 parts. The results thereof are shown in Table 1.

Preparation of Cerium Oxide (14)

Cerium oxide (14) is prepared in the same preparation method of Cerium oxide (1), except that the content of tributyl phosphate (TBP) is changed from 9.5% to 12.2% and the amount of aqueous nitric acid solution is changed from 504 parts to 463 parts. The results thereof are shown in Table 1.

Preparation of Cerium Oxide (15)

Cerium oxide (15) is prepared in the same preparation method of Cerium oxide (1), except that the content of tributyl phosphate (TBP) is changed from 9.5% to 12.2% and the amount of aqueous nitric acid solution is changed from 504 parts to 494 parts. The results thereof are shown in Table 1.

Preparation of Cerium Oxide (16)

Cerium oxide (16) is prepared in the same preparation method of Cerium oxide (1), except that the content of tributyl phosphate (TBP) is changed from 9.5% to 6.8% and the amount of aqueous nitric acid solution is changed from 504 parts to 542 parts. The results thereof are shown in Table 1.

Preparation of Cerium Oxide (17)

Cerium oxide (17) is prepared in the same preparation method of Cerium oxide (1), except that the content of tributyl phosphate (TBP) is changed from 9.5% to 5.8% and the amount of aqueous nitric acid solution is changed from 504 parts to 585 parts. The results thereof are shown in Table 1.

Preparation of Cerium Oxide (18)

Cerium oxide (18) is prepared in the same preparation method of Cerium oxide (1), except that the content of tributyl phosphate (TBP) is changed from 9.5% to 12.2% and the amount of aqueous nitric acid solution is changed from 504 parts to 498 parts. The results thereof are shown in Table 1.

Preparation of Cerium Oxide (19)

Cerium oxide (19) is prepared in the same preparation method of Cerium oxide (1), except that the content of tributyl phosphate (TBP) is changed from 9.5% to 12.2% and the amount of aqueous nitric acid solution is changed from 504 parts to 536 parts. The results thereof are shown in Table 1.

Preparation of Cerium Oxide (20)

Cerium oxide (20) is prepared in the same preparation method of Cerium oxide (1), except that the content of tributyl phosphate (TBP) is changed from 9.5% to 5.5% and the amount of aqueous nitric acid solution is changed from 504 parts to 513 parts. The results thereof are shown in Table 1.

Preparation of Cerium Oxide (21)

Cerium oxide (21) is prepared in the same preparation method of Cerium oxide (1), except that the content of tributyl phosphate (TBP) is changed from 9.5% to 5.5% and the amount of aqueous nitric acid solution is changed from 504 parts to 586 parts. The results thereof are shown in Table 1.

Preparation of Cerium Oxide (22)

Cerium oxide (22) is prepared in the same preparation method of Cerium oxide (1), except that the content of tributyl phosphate (TBP) is changed from 9.5% to 5.8% and the amount of aqueous nitric acid solution is changed from 504 parts to 598 parts. The results thereof are shown in Table 1.

Preparation of Cerium Oxide (23)

Cerium oxide (23) is prepared in the same preparation method of Cerium oxide (1), except that the content of tributyl phosphate (TBP) is changed from 9.5% to 12.2% and the amount of aqueous nitric acid solution is changed from 504 parts to 549 parts. The results thereof are shown in Table 1.

Preparation of Cerium Oxide (24)

Cerium oxide (24) is prepared in the same preparation method of Cerium oxide (1), except that the content of tributyl phosphate (TBP) is changed from 9.5% to 2% and the amount of aqueous nitric acid solution is changed from 504 parts to 526 parts. The results thereof are shown in Table 1.

Preparation of Cerium Oxide (25)

Cerium oxide (25) is prepared in the same preparation method of Cerium oxide (1), except that the content of tributyl phosphate (TBP) is changed from 9.5% to 2% and the amount of aqueous nitric acid solution is changed from 504 parts to 937 parts. The results thereof are shown in Table 1.

Preparation of Cerium Oxide (26)

Cerium oxide (26) is prepared in the same preparation method of Cerium oxide (1), except that the content of tributyl phosphate (TBP) is changed from 9.5% to 12.2% and the amount of aqueous nitric acid solution is changed from 504 parts to 873 parts. The results thereof are shown in Table 1.

Preparation of Cerium Oxide (27)

Cerium oxide (27) is prepared in the same preparation method of Cerium oxide (1), except that the content of tributyl phosphate (TBP) is changed from 9.5% to 1% and the amount of aqueous nitric acid solution is changed from 504 parts to 529 parts. The results thereof are shown in Table 1.

Preparation of Cerium Oxide (28)

Cerium oxide (28) is prepared in the same preparation method of Cerium oxide (1), except that the content of tributyl phosphate (TBP) is changed from 9.5% to 1% and the amount of aqueous nitric acid solution is changed from 504 parts to 940 parts. The results thereof are shown in Table 1.

Preparation of Cerium Oxide (29)

Cerium oxide (29) is prepared in the same preparation method of Cerium oxide (1), except that the content of tributyl phosphate (TBP) is changed from 9.5% to 2% and the amount of aqueous nitric acid solution is changed from 504 parts to 972 parts. The results thereof are shown in Table 1.

Preparation of Cerium Oxide (30)

Cerium oxide (30) is prepared in the same preparation method of Cerium oxide (1), except that the content of tributyl phosphate (TBP) is changed from 9.5% to 12.2% and the amount of aqueous nitric acid solution is changed from 504 parts to 908 parts. The results thereof are shown in Table 1.

Preparation of Cerium Oxide (31)

Cerium oxide (31) is prepared in the same preparation method of Cerium oxide (1), except that the content of tributyl phosphate (TBP) is changed from 9.5% to 13% and the amount of aqueous nitric acid solution is changed from 504 parts to 864 parts. The results thereof are shown in Table 1.

Preparation of Cerium Oxide (32)

Cerium oxide (32) is prepared in the same preparation method of Cerium oxide (1), except that the content of tributyl phosphate (TBP) is changed from 9.5% to 13% and the amount of aqueous nitric acid solution is changed from 504 parts to 453 parts. The results thereof are shown in Table 1.

Preparation of Cerium Oxide (33)

Cerium oxide (33) is prepared in the same preparation method of Cerium oxide (1), except that the content of tributyl phosphate (TBP) is changed from 9.5% to 12.2% and the amount of aqueous nitric acid solution is changed from 504 parts to 461 parts. The results thereof are shown in Table 1.

Preparation of Cerium Oxide (34)

Cerium oxide (34) is prepared in the same preparation method of Cerium oxide (1), except that the content of tributyl phosphate (TBP) is changed from 9.5% to 2% and the amount of aqueous nitric acid solution is changed from 504 parts to 524 parts. The results thereof are shown in Table 1.

TABLE 1

| | Cerium (Ce) Content (%) | Praseodymium (Pr) Content (%) | Ce/Pr |
|---|---|---|---|
| Cerium Oxide (1) | 97.8 | 2.1 | 46.6 |
| Cerium Oxide (2) | 98.9 | 1.1 | 89.9 |
| Cerium Oxide (3) | 99.3 | 0.7 | 141.9 |
| Cerium Oxide (4) | 95.6 | 4.2 | 22.8 |
| Cerium Oxide (5) | 97.1 | 2.7 | 36.0 |
| Cerium Oxide (6) | 95.3 | 4.5 | 21.2 |
| Cerium Oxide (7) | 96.9 | 3.0 | 32.3 |
| Cerium Oxide (8) | 91.7 | 7.9 | 11.6 |
| Cerium Oxide (9) | 94.5 | 5.3 | 17.8 |
| Cerium Oxide (10) | 98.5 | 1.4 | 70.4 |
| Cerium Oxide (11) | 98.7 | 1.2 | 82.3 |
| Cerium Oxide (12) | 94.2 | 5.5 | 17.1 |
| Cerium Oxide (13) | 95.0 | 4.8 | 19.8 |
| Cerium Oxide (14) | 99.3 | 0.6 | 165.5 |
| Cerium Oxide (15) | 97.4 | 2.5 | 39.0 |
| Cerium Oxide (16) | 94.6 | 5.1 | 18.5 |
| Cerium Oxide (17) | 89.2 | 10.3 | 8.7 |
| Cerium Oxide (18) | 97.2 | 2.7 | 36.0 |
| Cerium Oxide (19) | 95.0 | 4.8 | 19.8 |
| Cerium Oxide (20) | 98.4 | 1.5 | 65.6 |
| Cerium Oxide (21) | 88.5 | 10.9 | 8.1 |
| Cerium Oxide (22) | 87.7 | 11.8 | 7.4 |
| Cerium Oxide (23) | 94.3 | 5.5 | 17.1 |
| Cerium Oxide (24) | 97.6 | 2.3 | 42.4 |
| Cerium Oxide (25) | 50.8 | 46.9 | 1.1 |
| Cerium Oxide (26) | 79.0 | 20.0 | 4.0 |
| Cerium Oxide (27) | 97.4 | 2.4 | 40.6 |
| Cerium Oxide (28) | 48.8 | 48.8 | 1.0 |
| Cerium Oxide (29) | 48.8 | 48.8 | 1.0 |
| Cerium Oxide (30) | 77.7 | 21.3 | 3.6 |
| Cerium Oxide (31) | 80.6 | 18.4 | 4.4 |
| Cerium Oxide (32) | 99.4 | 0.6 | 165.7 |
| Cerium Oxide (33) | 99.5 | 0.5 | 199.0 |
| Cerium Oxide (34) | 98.1 | 1.8 | 54.5 |

Preparation of Release Agent Particle Dispersion (1)

Paraffin wax (manufactured by NIPPON SEIRO CO., LTD., FT115, melting temperature: 113° C.): 100 parts Anionic surfactant (manufactured by DAI-ICHI KOGYO SEIYAKU CO., LTD., NEOGEN RK): 1.0 part Ion exchange water: 400 parts The above components are mixed, heated at 95° C., dispersed using a homogenizer (manufactured by IKA Japan K.K, ULTRA-TURRAX T50), and dispersed for 360 minutes using Manton-Gaulin high-pressure homogenizer (manufactured by APV Gaulin, Inc.). Release agent particles with a volume average particle size of 0.23 μm are dispersed therein. As a result, Release agent particle dispersion (1) (solid content: 20%) is prepared.

Synthesis of Respective Polyester Resins

Synthesis of Polyester Resin (1)

Dimethyl adipate: 74 parts

Dimethyl terephthalat: 192 parts

Bisphenol A ethylene oxide 2 mol adduct: 216 parts

Ethylene glycol: 38 parts

Tetrabutoxy titanate (catalyst): 0.037 part

The above components are heated, dried, and put into a two-neck flask, and nitrogen gas is put into a vessel to keep an inert gas atmosphere, followed by heating under stirring and a copolycondensation reaction at 160° C. for 7 hours. Then, the resultant is heated to 220° C. and held for 4 hours while slowly reducing the pressure to 10 Torr. The pressure is temporarily returned to normal pressure, 9 parts of trimellitic anhydride is added, and the pressure is slowly reduced to 10 Torr again. The resultant is held for 1 hour at 220° C. As a result, Polyester resin (1) is synthesized.

The glass transition temperature of Polyester resin (1) thus obtained is 65° C. when measured using the differential scanning calorimetry (DSC). When the molecular weight of Polyester resin (1) thus obtained is measured using GPC, the weight average molecular weight (Mw) is 12000 and the number average molecular weight (Mn) is 4000.

Synthesis of Polyester Resin (2)

Bisphenol A ethylene oxide 2 mol adduct: 114 parts

Bisphenol A propylene oxide 2 mol adduct: 84 parts

Fumaric acid dimethyl ester: 75 parts

Dodecenyl succinic acid: 19.5 parts

Trimellitic acid: 7.5 parts

The above components are put into a 5 liter flask which is equipped with a stirring device, a nitrogen inlet tube, a temperature sensor, and a rectifier, heated to 190° C. across 1 hour, and stirred in a reaction system. Then, 3.0 parts of dibutyltin oxide is put thereto. Furthermore, the resultant is heated from 190° C. to 240° C. across 6 hours while distilling water, followed by a dehydration condensation reaction for 2 hours at 240° C. As a result, Polyester resin (2) is synthesized.

In Polyester resin (2) thus obtained, the glass transition temperature is 57° C., the acid value is 15.0 mgKOH/g, the weight average molecular weight (Mw) is 58000 and the number average molecular weight (Mn) is 5600.

Synthesis of Polyester Resin (3)

Dimethyl adipate: 74 parts

Dimethyl terephthalate: 192 parts

Propylene glycol: 106 parts

Ethylene glycol: 138 parts

Tetrabutoxy titanate (catalyst): 0.05 part

The above components are heated, dried, and put into a two-neck flask, and nitrogen gas is put into a vessel to keep an inert gas atmosphere, followed by heating under stirring and a copolycondensation reaction at 180° C. for 7 hours. Then, the resultant is heated to 225° C. and held for 5 hours while slowly reducing the pressure to 10 Torr. As a result, Polyester resin (3) is synthesized.

The glass transition temperature of Polyester resin (3) thus obtained is 63° C. When the molecular weight of Polyester resin (3) thus obtained is measured using GPC, the weight average molecular weight (Mw) is 13000 and the number average molecular weight (Mn) is 4200.

Preparation of Respective Polyester Resin Dispersion

Preparation of Polyester Resin Dispersion (1)

Polyester resin (1): 160 parts

Ethyl acetate; 233 parts

Aqueous sodium hydroxide (0.3 N): 0.1 part

The above components are put into a 1000 ml separable flask, heated at 70° C., and stirred using THREE-ONE MOTOR (manufactured by Shinto Scientific Co., Ltd.) to prepare a resin mixture. 373 parts of ion exchange water is slowly added to this resin mixture while stirring the resin mixture, followed by phase-transfer emulsification and treatment with a desolventizer. As a result, Polyester resin dispersion (1) (solid content: 30%) is obtained. The volume average particle size of resin particles in the dispersion is 160 nm.

Preparation of Polyester Resin Dispersion (2)

Polyester resin dispersion (2) (solid content: 30%) is prepared in the same preparation method as that of Polyester resin dispersion (1), except that Polyester resin (2) is used instead of Polyester resin (1). The volume average particle size of resin particles in the dispersion is 180 nm.

Preparation of Polyester Resin Dispersion (3)

Polyester resin dispersion (3) (solid content: 30%) is prepared in the same preparation method as that of Polyester resin dispersion (1), except that Polyester resin (3) is used instead of Polyester resin (1). The volume average particle size of rein particles in the dispersion is 170 nm.

Preparation of Toner Particles A

Ion exchange water: 450 parts

Polyester resin dispersion (1): 210 parts

Polyester resin dispersion (2): 210 parts

Anionic surfactant (manufactured by DAI-ICHI KOGYO SEIYAKU CO., LTD., NEOGEN RK, 20%): 2.8 parts The above components are put into a 3 liter reactor vessel equipped with a thermometer, a pH meter, and a stirring device, and are held at a temperature of 30° C. and a stirring rotation speed of 150 rpm for 30 minutes while controlling the temperature using a mantle heater from outside. Then, 100 parts of Release agent particle dispersion (1) is input thereto and held for 5 minutes. 1.0% aqueous nitric acid solution is added and the pH value in the aggregation process is adjusted to 3.0.

While dispersion is performed using a homogenizer (manufactured by IKA Japan K.K., ULTRA-TURRAX T50), 0.4 part of polyaluminum chloride is added. The resultant is heated to 50° C. under stirring and the particle sizes thereof are measured using Coulter Multisizer II (aperture diameter: 50 μm, manufactured by Beckman Coulter, Inc.). The volume average particle size is 5.5 μm. Then, 110 parts of Polyester resin dispersion (1) and 73 parts of Polyester resin dispersion (2) are additionally added and the resin particles are bonded to the surface of the aggregated particles.

Next, the pH value is adjusted to 9.0 using 5% aqueous sodium hydroxide. Then, the resultant is heated to 90° C. at a temperature rise rate of 0.05° C./min, held at 90° C. for 3 hours, cooled, and filtrated to obtain coarse toner particles. These coarse toner particles are dispersed in ion exchange water again and filtrated repeatedly, washed until the electrical conductivity of filtrate is less than or equal to 20 μS/cm, and dried in a vacuum in an oven at 40° C. for 10 hours. As a result, Toner particles A with a volume average particle size of 5.8 μm are obtained.

Preparation of Toner Particles B

Toner particles B are obtained in the same preparation method as that of Toner particles A, except that 420 parts of Polyester resin dispersion (1) is added instead of using Polyester resin dispersion (2) and 183 parts of Polyester resin dispersion (1) is additionally added.

Preparation of Toner Particles C

Toner particles C are obtained in the same preparation method as that of Toner particles B, except that Polyester resin dispersion (3) is used instead of Polyester resin dispersion (1).

Preparation of Toner Particles D

Polyester resin (1): 126 parts

Polyester resin (2): 126 parts

Paraffin wax (manufactured by NIPPON SEIRO CO., LTD., FT115): 40 parts

The above components are put into a Banbury mixer (manufactured by KOBE STEEL., LTD.) and pressure is added such that the inner temperature is 110±5° C., followed by kneading for 10 minutes at 80 rpm. The kneaded components are coarsely crushed using a hammer mill, finely crushed to approximately 6.8 μm using a jet mill, and classified using an elbow-jet classifier (manufactured by MATSUBO Corporation). As a result, Toner particles D are obtained.

Preparation of Toner (1)

0.176 part of Cerium oxide (1) as the external additive and 1.50 parts of hydrophobic silica (manufactured by Nippon Aerosil Co., Ltd., RY50) are added to 98.324 parts of Toner particles A obtained above.

Next, mixing is performed using Henschel mixer at a peripheral speed of 30 m/s for 3 minutes. Then, the mixture is screened using a vibration screening machine with an aperture diameter of 45 μm. As a result, Toner (1) is prepared.

The volume average particle size of Toner (1) thus obtained is 6.1 μm.

When measured in the above-described method, the content of cerium and the content of praseodymium in all toner particles of Toner (1) are shown in Table 2.

Preparation of Carrier 14 parts of toluene, 2 parts of styrene-methylmethacrylate copolymer (weight ratio: 80/20, weight average particle size: 70000), and 0.6 parts of MZ500 (zinc oxide, manufactured by Titan Kogyo, Ltd.) are mixed and stirred with a stirrer for 10 minutes. As a result, a coating layer-forming solution in which zinc oxide is dispersed is prepared. Next, this coating solution and 100 parts of ferrite particles (volume average particle size: 38 μm) are put into a vacuum deaeration-type kneader, stirred for 30 minutes at 60° C., reduced in pressure and deaerated while heating it, and dried. As a result, a carrier is prepared.

Preparation of Electrostatic Latent Image Developer 100 parts of carrier obtained above and 8 parts of Toner (1) are blended using a V-blender to obtain Electrostatic latent image developer (1).

Preparation of Toners (2) to (34) and Electrostatic Latent Image Developers (2) to (34)

Using Cerium oxides (2) to (34) instead of Cerium oxide (1) of Example 1, Toners (2) to (34) and Electrostatic latent image developers (2) to (34) are prepared. The amounts of toner particles and an external additive are shown in Table 2.

Preparation of Toner (35) and Electrostatic Latent Image Developer (35)

Toner (35) and Electrostatic latent image developer (35) are prepared in the same preparation method as that of Toner (1), except that Toner particles B are used instead of Toner particles A. The amount of toner particles and the amount of an external additive are shown in Table 2.

Preparation of Toner (36) and Electrostatic Latent Image Developer (36)

Toner (36) and Electrostatic latent image developer (36) are prepared in the same preparation method as that of Toner (1), except that Toner particles C are used instead of Toner particles A. The amount of toner particles and the amount of an external additive are shown in Table 2, Preparation of Toner (37) and Electrostatic Latent Image Developer (37)

Toner (37) and Electrostatic latent image developer (37) are prepared in the same preparation method as that of Toner (1), except that Toner particles D are used instead of Toner particles A. The amount of toner particles and the amount of an external additive are shown in Table 2.

Examples 1 to 29 and Comparative Examples 1 to 8

The following evaluations are performed using Toners (1) to (37) and Electrostatic latent image developers (1) to (37). Toners and developers used and the results thereof are shown in Table 3.

Image Transparency

A developer unit of a 5-tandem-type DocuCentre-III C7600-modified machine (5-tandem-modified machine, manufactured by Fuji Xerox Co., Ltd.) is filled with the developer obtained above. Then, A4-size (18 cm×27 cm) solid images are formed on recording paper (OK TOP-COAT+, manufactured by Oji paper Co., Ltd.) under an environment in which the amount of toner particles deposited is adjusted to 4.0 g/m$^2$ and the fixing temperature is 190° C. The hazes of formed solid images are evaluated. Specifically, an image is visually inspected by 20 inspectors and whether or not there is haze on the image is determined. The evaluation criteria are as follows.

In addition, images in which the amount of toner particles deposited is adjusted to 20.0 g/m$^2$, are also evaluated in the same method. G2 to G5 are considered as "no problem". The results are shown in Table 3.

Evaluation Criteria

G5: 18 or more inspectors out of 20 inspectors determine that an image has no haze or yellow color G4: 16 or 17 inspectors out of 20 inspectors determine that an image has no haze or yellow color G3: 14 or 15 inspectors out of 20 inspectors determine that an image has no haze or yellow color G2: 12 or 13 inspectors out of 20 inspectors determine that an image has no haze or yellow color G1: 11 or less inspectors out of 20 inspectors determine that an image has no haze or yellow color The above evaluations are performed with light sources having different color temperatures.

4000K: Slim PA-LOOK fluorescent lamp (FHF24SEW, manufactured by Panasonic Corporation)

5000K: Slim PA-LOOK fluorescent lamp (FHF24SEN, manufactured by Panasonic Corporation)

Abradability on Photoreceptor

The machine used for the evaluation of image transparency is left to stand for 12 hours under the environment of an air temperature of 30° C. and a humidity of 85% and prints 1000 images. The images are obtained by cleaning them without transferring solid images in which the amount of toner particles deposited is 4.0 g/m$^2$. After the 1000 images are printed, the surface of the photoreceptor is observed and whether or not there are any scratches and a state of being wiped are visually inspected. The evaluation criteria are as follows. In addition, G2 to G4 are considered as "usable".

Evaluation Criteria

G4: Attached substances and abrasion are not found on the surface of a photoreceptor G3: Small attached substances or abrasion is found on the surface of a photoreceptor but does not have an effect on an image G2: Attached substances or abrasion is found on the surface of a photoreceptor but has a small effect on an image G1: Attached substances or abrasion is found on the surface of a photoreceptor and has a large effect on an image The thicknesses of toner images according to Examples and Comparative Examples in which the amount of toner particles deposited is 4.0 g/m$^2$, are 6 μm. In addition, when the amount of toner particles deposited is 20.0 g/m$^2$, the thicknesses of the toner images are 40 μm.

According to the exemplary embodiment, the following points are clarified. That is, when the contents of cerium and praseodymium in all toner particles are in the range described above in the exemplary embodiment, a deterioration in the transparency of the transparent toner may be suppressed and appropriate abradability on a photoreceptor may be exhibited.

TABLE 2

| | Toner Particles | | Cerium Oxide | | Hydrophobic Silica | Content of Ce | Content of Pr | |
|---|---|---|---|---|---|---|---|---|
| | Kind | (Part) | Kind | (Part) | (Part) | (%) | (%) | Ce/Pr |
| Toner (1) | A | 98.324 | 1 | 0.176 | 1.50 | 0.14 | 0.0030 | 46.7 |
| Toner (2) | A | 98.363 | 2 | 0.137 | 1.50 | 0.11 | 0.0012 | 91.7 |
| Toner (3) | A | 98.290 | 3 | 0.210 | 1.50 | 0.17 | 0.0012 | 141.7 |
| Toner (4) | A | 98.359 | 4 | 0.141 | 1.50 | 0.11 | 0.0048 | 22.9 |
| Toner (5) | A | 98.285 | 5 | 0.215 | 1.50 | 0.17 | 0.0048 | 35.4 |
| Toner (6) | A | 98.358 | 6 | 0.142 | 1.50 | 0.11 | 0.0052 | 21.2 |
| Toner (7) | A | 98.284 | 7 | 0.216 | 1.50 | 0.17 | 0.0052 | 32.7 |
| Toner (8) | A | 98.353 | 8 | 0.147 | 1.50 | 0.11 | 0.0095 | 11.6 |
| Toner (9) | A | 98.279 | 9 | 0.221 | 1.50 | 0.17 | 0.0095 | 17.9 |
| Toner (10) | A | 98.398 | 10 | 0.102 | 1.50 | 0.082 | 0.0012 | 68.3 |
| Toner (11) | A | 98.381 | 11 | 0.119 | 1.50 | 0.096 | 0.0012 | 80.0 |
| Toner (12) | A | 98.393 | 12 | 0.107 | 1.50 | 0.082 | 0.0048 | 17.1 |
| Toner (13) | A | 98.376 | 13 | 0.124 | 1.50 | 0.096 | 0.0048 | 20.0 |
| Toner (14) | A | 98.265 | 14 | 0.235 | 1.50 | 0.19 | 0.0012 | 158.3 |
| Toner (15) | A | 98.260 | 15 | 0.240 | 1.50 | 0.19 | 0.0048 | 39.6 |
| Toner (16) | A | 98.375 | 16 | 0.125 | 1.50 | 0.096 | 0.0052 | 18.5 |
| Toner (17) | A | 98.387 | 17 | 0.113 | 1.50 | 0.082 | 0.0095 | 8.6 |
| Toner (18) | A | 98.260 | 18 | 0.240 | 1.50 | 0.19 | 0.0052 | 36.5 |
| Toner (19) | A | 98.254 | 19 | 0.246 | 1.50 | 0.19 | 0.0095 | 20.0 |
| Toner (20) | A | 98.404 | 20 | 0.096 | 1.50 | 0.077 | 0.0012 | 64.2 |
| Toner (21) | A | 98.393 | 21 | 0.107 | 1.50 | 0.077 | 0.0095 | 8.1 |
| Toner (22) | A | 98.385 | 22 | 0.115 | 1.50 | 0.082 | 0.0110 | 7.5 |
| Toner (23) | A | 98.252 | 23 | 0.248 | 1.50 | 0.19 | 0.0110 | 17.3 |
| Toner (24) | A | 98.435 | 24 | 0.065 | 1.50 | 0.052 | 0.0012 | 43.3 |
| Toner (25) | A | 98.374 | 25 | 0.126 | 1.50 | 0.052 | 0.0480 | 1.1 |

TABLE 2-continued

| | Toner Particles | | Cerium Oxide | | Hydrophobic Silica | Content of Ce | Content of Pr | |
|---|---|---|---|---|---|---|---|---|
| | Kind | (Part) | Kind | (Part) | (Part) | (%) | (%) | Ce/Pr |
| Toner (26) | A | 98.205 | 26 | 0.295 | 1.50 | 0.19 | 0.0480 | 4.0 |
| Toner (27) | A | 98.439 | 27 | 0.061 | 1.50 | 0.048 | 0.0012 | 40.0 |
| Toner (28) | A | 98.379 | 28 | 0.121 | 1.50 | 0.048 | 0.0480 | 1.0 |
| Toner (29) | A | 98.369 | 29 | 0.131 | 1.50 | 0.052 | 0.0520 | 1.0 |
| Toner (30) | A | 98.200 | 30 | 0.300 | 1.50 | 0.19 | 0.0520 | 3.7 |
| Toner (31) | A | 98.180 | 31 | 0.320 | 1.50 | 0.21 | 0.0480 | 4.4 |
| Toner (32) | A | 98.240 | 32 | 0.260 | 1.50 | 0.21 | 0.0012 | 175.0 |
| Toner (33) | A | 98.265 | 33 | 0.235 | 1.50 | 0.19 | 0.00096 | 197.9 |
| Toner (34) | A | 98.435 | 34 | 0.065 | 1.50 | 0.052 | 0.00096 | 54.2 |
| Toner (35) | B | 98.324 | 1 | 0.176 | 1.50 | 0.14 | 0.0030 | 46.7 |
| Toner (36) | C | 98.324 | 1 | 0.176 | 1.50 | 0.14 | 0.0030 | 46.7 |
| Toner (37) | D | 98.324 | 1 | 0.176 | 1.50 | 0.14 | 0.0030 | 46.7 |

TABLE 3

| | | Evaluation | | | | | | |
|---|---|---|---|---|---|---|---|---|
| | Toner | Amount of Toner Particles Deposited ($g/m^2$) | (4000K) | (5000K) | Amount of Toner Particles Deposited ($g/m^2$) | (4000K) | (5000K) | Abradability |
| Example 1 | Toner (1) | 4 | G5 | G5 | 20 | G5 | G5 | G4 |
| Example 2 | Toner (2) | 4 | G5 | G5 | 20 | G5 | G5 | G4 |
| Example 3 | Toner (3) | 4 | G5 | G5 | 20 | G5 | G4 | G4 |
| Example 4 | Toner (4) | 4 | G5 | G5 | 20 | G5 | G5 | G4 |
| Example 5 | Toner (5) | 4 | G5 | G5 | 20 | G5 | G5 | G4 |
| Example 6 | Toner (6) | 4 | G5 | G5 | 20 | G5 | G4 | G4 |
| Example 7 | Toner (7) | 4 | G5 | G5 | 20 | G5 | G4 | G4 |
| Example 8 | Toner (8) | 4 | G5 | G5 | 20 | G4 | G4 | G4 |
| Example 9 | Toner (9) | 4 | G5 | G5 | 20 | G4 | G4 | G4 |
| Example 10 | Toner (10) | 4 | G5 | G5 | 20 | G5 | G4 | G3 |
| Example 11 | Toner (11) | 4 | G5 | G5 | 20 | G5 | G4 | G3 |
| Example 12 | Toner (12) | 4 | G5 | G5 | 20 | G4 | G4 | G3 |
| Example 13 | Toner (13) | 4 | G5 | G5 | 20 | G5 | G4 | G3 |
| Example 14 | Toner (14) | 4 | G5 | G5 | 20 | G4 | G4 | G2 |
| Example 15 | Toner (15) | 4 | G5 | G5 | 20 | G5 | G4 | G2 |
| Example 16 | Toner (16) | 4 | G5 | G4 | 20 | G3 | G3 | G3 |
| Example 17 | Toner (17) | 4 | G5 | G4 | 20 | G3 | G3 | G3 |
| Example 18 | Toner (18) | 4 | G5 | G4 | 20 | G4 | G3 | G2 |
| Example 19 | Toner (19) | 4 | G5 | G4 | 20 | G4 | G3 | G2 |
| Example 20 | Toner (20) | 4 | G4 | G4 | 20 | G3 | G3 | G2 |
| Example 21 | Toner (21) | 4 | G4 | G4 | 20 | G3 | G2 | G2 |
| Example 22 | Toner (22) | 4 | G4 | G4 | 20 | G3 | G2 | G3 |
| Example 23 | Toner (23) | 4 | G4 | G4 | 20 | G3 | G2 | G2 |
| Example 24 | Toner (24) | 4 | G4 | G4 | 20 | G3 | G3 | G2 |
| Example 25 | Toner (25) | 4 | G4 | G4 | 20 | G3 | G2 | G2 |
| Example 26 | Toner (26) | 4 | G4 | G4 | 20 | G3 | G2 | G2 |
| Example 27 | Toner (35) | 4 | G5 | G5 | 20 | G5 | G4 | G4 |
| Example 28 | Toner (36) | 4 | G5 | G5 | 20 | G5 | G4 | G4 |
| Example 29 | Toner (37) | 4 | G4 | G4 | 20 | G4 | G4 | G4 |
| Comparative Example 1 | Toner (27) | 4 | G4 | G4 | 20 | G3 | G3 | G1 |
| Comparative Example 2 | Toner (28) | 4 | G4 | G4 | 20 | G3 | G2 | G1 |
| Comparative Example 3 | Toner (29) | 4 | G3 | G1 | 20 | G2 | G1 | G2 |
| Comparative Example 4 | Toner (30) | 4 | G3 | G1 | 20 | G2 | G1 | G2 |
| Comparative Example 5 | Toner (31) | 4 | G4 | G4 | 20 | G3 | G2 | G1 |
| Comparative Example 6 | Toner (32) | 4 | G4 | G4 | 20 | G3 | G3 | G1 |
| Comparative Example 7 | Toner (33) | 4 | G3 | G1 | 20 | G2 | G1 | G2 |
| Comparative Example 8 | Toner (34) | 4 | G3 | G1 | 20 | G2 | G1 | G2 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent toner for developing an electrostatic latent image comprising:

toner particles containing a binder resin; and an external additive containing cerium oxide, wherein a content of cerium in all toner particles is from 0.05% by weight to 0.20% by weight based on a total weight of all toner particles, the cerium oxide contains a praseodymium, and a content of praseodymium in all toner particles is from 0.001% by weight to 0.050% by weight based on the total weight of all toner particles.

2. The transparent toner for developing an electrostatic latent image according to claim 1, wherein the content of praseodymium in all toner particles is from 0.001% by weight to 0.010% by weight based on the total weight of all toner particles.

3. The transparent toner for developing an electrostatic latent image according to claim 1, wherein the binder resin is polyester.

4. The transparent toner for developing an electrostatic latent image according to claim 1, wherein a volume average particle size of the cerium oxide is in a range of 0.3 μm to 5.0 μm.

5. The transparent toner for developing an electrostatic latent image according to claim 1, wherein an amount of the cerium oxide is from 0.05 part by weight to 1.0 part by weight with respect to 100 parts by weight of the toner particles.

6. The transparent toner for developing an electrostatic latent image according to claim 1, wherein a ratio of cerium to praseodymium (Ce/Pr) in the cerium oxide is in the range of 20 to 150.

7. An electrostatic latent image developer comprising:

the transparent toner for developing an electrostatic latent image according to claim 1.

8. The electrostatic latent image developer according to claim 7, wherein, in the transparent toner for developing an electrostatic latent image, the content of praseodymium in all toner particles is from 0.001% by weight to 0.010% by weight based on the total weight of all toner particles.

9. A process cartridge for an image forming apparatus comprising:

an image holding member; and a developing unit that forms a toner image by developing an electrostatic latent image, which is formed on a surface of the image holding member, using a developer, wherein the developer is the electrostatic latent image developer according to claim 7.

10. The process cartridge for an image forming apparatus according to claim 9, wherein, in the transparent toner for developing an electrostatic latent image, the content of praseodymium in all toner particles is from 0.001% by weight to 0.010% by weight based on the total weight of all toiler particles.

11. An image forming apparatus comprising:

an image holding member;

a charging unit that charges a surface of the image holding member with electricity;

a latent image forming unit that forms an electrostatic latent image on the surface of the image holding member;

a developing unit that forms a toner image by developing the electrostatic latent image, which is formed on the surface of the image holding member, using a developer; and a transfer unit that transfers the formed toner image onto a transfer medium, wherein the developer is the electrostatic latent image developer according to claim 7.

12. The image forming apparatus according to claim 11, wherein, in the transparent toner for developing an electrostatic latent image, the content of praseodymium in all toner particles is from 0.001% by weight to 0.010% by weight based on the total weight of all toner particles.

13. An image forming method comprising:

charging a surface of an image holding member with electricity;

forming an electrostatic latent image on the surface of the image holding member;

developing the electrostatic latent image to form a toner image by using a developer; and transferring the toner image onto a transfer medium, wherein the developer is the electrostatic latent image developer according to claim 7.

14. The image forming method according to claim 13, wherein, in the transparent toner for developing an electrostatic latent image, the content of praseodymium in all toner particles is from 0.001% by weight to 0.010% by weight based on the total weight of all toner particles.

15. The image forming method according to claim 13, wherein an amount of toner particles, which are deposited on the toner image transferred onto the transfer medium, is from 3.0 $g/m^2$ to 20.0 $g/m^2$.

16. A toner cartridge comprising:

a toner accommodation container, wherein the toner accommodation container contains the transparent toner for developing an electrostatic latent image according to claim 1.

17. The toner cartridge according to claim 16, wherein, in the transparent toner for developing an electrostatic latent image, the content of praseodymium in all toner particles is from 0.001% by weight to 0.010% by weight based on the total weight of all toner particles.

18. A toner image which is formed, using the transparent toner for developing an electrostatic latent image according to claim 1, on a transfer medium with a thickness of 6.0 μm to 40.0 μm.

19. The transparent toner for developing an electrostatic latent image according to claim 1, further comprising a pigment in an amount of 100 ppm or less.

* * * * *